United States Patent [19]

D'Urso et al.

[11] Patent Number: 4,699,441

[45] Date of Patent: Oct. 13, 1987

[54] ELECTRICAL CONNECTOR FOR STRANDED WIRES

[75] Inventors: Gianfranco D'Urso; Vladimiro Teagno, both of Turin, Italy

[73] Assignee: AMP Incorporated, Harrisburg, Pa.

[21] Appl. No.: 650,391

[22] Filed: Sep. 14, 1984

[51] Int. Cl.[4] ..... H01R 4/24

[52] U.S. Cl. ..... 439/397

[58] Field of Search ..... 339/97 R, 97 P, 98, 339/99 R

[56] References Cited

U.S. PATENT DOCUMENTS

| | | | |
|---|---|---|---|
| 3,760,331 | 9/1973 | Furley | 339/97 P |
| 3,845,455 | 10/1974 | Shoemaker | 339/97 R |
| 3,926,498 | 12/1975 | Hoppe, Jr. | 339/97 R |
| 4,050,760 | 9/1977 | Cohen | 339/97 R |
| 4,230,391 | 10/1980 | Keglewitsch | 339/97 R |
| 4,231,632 | 11/1980 | Bardoz et al. | 339/97 R |
| 4,291,935 | 9/1981 | Bardoz et al. | 339/97 R |
| 4,346,955 | 8/1982 | Chesnais et al. | 339/97 R |
| 4,421,375 | 12/1983 | Coldren | 339/97 R |

*Primary Examiner*—Joseph H. McGlynn
*Attorney, Agent, or Firm*—Robert W. J. Usher

[57] ABSTRACT

A one-piece terminal having a contact portion (13) extending from a channel section wire connecting portion (11). Limbs (17, 17') extend toward each other from opposite axial ends of the sidewalls (15, 15') with opposed edges defining between them a wire receiving slot (26), a portion (22, 22') of each sidewall (15, 15') adjacent a limb (17, 17') being inclined inwardly of the channel as it extends away from the base (14) and towards the limb (17, 17') to provide a stiffly compliant slot (19). A panel (25) upstands from the base (14) between the sidewalls (15, 15') to provide sealant barrier and a rigid slot (26) aligned with the compliant slot (19). Extensions of the sidewalls (33, 33') are secured together by ties (34, 35).

6 Claims, 7 Drawing Figures

ELECTRICAL CONNECTOR FOR STRANDED WIRES

The invention relates to an electrical terminal for terminating insulated stranded wire and particularly to an electrical terminal for terminating insulated stranded wires of different sizes and having a large number of strands.

In the interests of economy, there is a widespread requirement for terminals which terminate insulated wires without a need for prior stripping of the insulation. Such self-stripping terminals may comprise a stamped and formed channel section body having sidewalls from axial ends of which extend limbs free of the channel base and bent towards each other perpendicularly of the channel axis with their opposed edges defining between them a wire receiving slot having a mouth remote from the channel base. An insulated wire extending axially of the channel can be forced through the mouth into the slot so that the edges penetrate the insulation and establish a permanent electrical connection to the wire core.

However, a disadvantage of such prior terminal is that the limbs are substantially rigid so that the terminal can be used to terminate reliably only wires of a single size. In addition, the rigidity of the limbs makes the terminal unsuitable for terminating stranded wire where compliance is required to avoid severing the strands during insertion into the slot.

One prior attempt to overcome the above-mentioned disadvantages is disclosed in U.S. Pat. No. 4,346,955 in which the limbs are carried by free ends of arms extending axially from the sidewalls and free of the base in cantilever beam fashion.

Whilst this increases the compliance of the slot to enable a small variation in the size of stranded wire that can be accommodated, the spring characteristic is too soft to enable a connection suitable for carrying sufficient high currents for many ordinary purposes such as powering automobile accessories. An increase in the thickness of the stock will result in an undesirable increase in weight and cost of the terminal, while prestressing the limbs together so that the slot edges are in abutment with each other may restrict the range of wire gauges that can be accommodated. The cantilever spring characteristic is not suitable for satisfying all the requirements for connection to a broad range of stranded wires with retention of good current carrying capability as well as a requirement for economical construction and compact size.

According to the invention, a terminal as described in the second paragraph is characterized in that a portion of at least one of the sidewalls adjacent the junction with the limb is inclined inwardly of the channel as it extends upwardly, away from the base and toward the limb. This portion defines a stiffly resilient gusset which permits the limbs to move relatively apart during wire insertion with a torsion spring component to enlarge the slot enabling the accommodation of a range of wire sizes while maintaining a good current carrying characteristic in the resultant connection with the wire.

Preferably, the portion is defined by pushing in the sidewall along a fold line extending from the junction of the limb and the sidewall adjacent the base away from the limb and upwardly towards the free end of the sidewall.

The gusset provides a spring characteristic of progressively increasing stiffness from the mouth of the slot to the base of the channel so that the force exerted on a wire increases progressively as the wire is forced down the slot.

Desirably, edges of the limbs adjacent the mouth are coined to provide a radiussed, flared entry for the wire with insulation penetrating teeth.

Advantageously, the slot may progressively taper in width as it extends from the mouth towards the base.

In one embodiment, a panel having another, rigid slot is bent to extend perpendicularly across the channel with the other slot axially aligned with the one slot, the width of the other slot being greater than the one slot in an unexpanded wire receiving condition.

The relative widths of the slots are chosen such that when wires throughout the entire range are inserted into the slots, both slots will effect electrical connection to the wires.

Preferably, the panel is pushed out from the channel base and has one or more laterally extending lugs received in cut-outs in the sidewalls to maintain the panel upstanding from the base during the insertion of the wire into the slots with the avoidance of twist of the panel.

This enables an economical and stable construction to be obtained.

The fold line may extend between the junction of the limb and the sidewall adjacent the base and the cut-outs.

Axial extensions of the sidewalls may be secured together against spreading at a location on a side of the panel remote from the compliant slot and formed inwardly in opposed relation to provide a contact portion comprising a pair of resilient legs for gripping a tab inserted between them.

As the sidewalls are secured together where not joined by a base, the terminal may be made of relatively thin stock while retaining sufficient strength for the legs to provide a satisfactory tab gripping force. In addition, any tendency for the rigid slot to expand during wire insertion will be resisted by the engagement of the sidewalls with the opposite edges of the panel which engagement also prevents the sidewalls from being moved together and therefore assists in maintaining constant the characteristics of the compliant slot.

Preferably, the sidewalls are secured together by first and second tie strips having root ends integral with upper edges of respective sidewalls and first and second transverse locking portions extending flag fashion adjacent free ends, the strips being bent at their root ends to extend towards each other between the sidewalls in overlapping relation and the first locking portion being crimped around the second tie strip to trap the second locking portion between the first locking portion and the sidewall from which it extends.

According to another aspect of the invention there is provided a one-piece stamped and formed terminal comprising a wire connecting portion and a contact portion, the wire connecting portion comprising a body of channel section having a base wall from respective opposite longitudinal edges of which upstand sidewalls, the contact portion comprising a pair of resilient legs extending axially from axial extensions of the sidewalls, a panel formed with a wire receiving slot being bent up from the base wall to extend across the channel thereby to isolate the contact portion from the wire connecting portion and tie means extending between the sidewall extendions to secure the sidewalls together.

The slotted panel both prevents any sealant injected into the wire connecting portion after wire termination therein from flowing towards the contact portion and provides wire connection.

Preferably, the wire connecting portion includes a second wire receiving slot located on a side of the panel remote from the contact portion.

An example of a terminal according to the invention will now be described with reference to the accompanying drawings in which.

Figure 1:
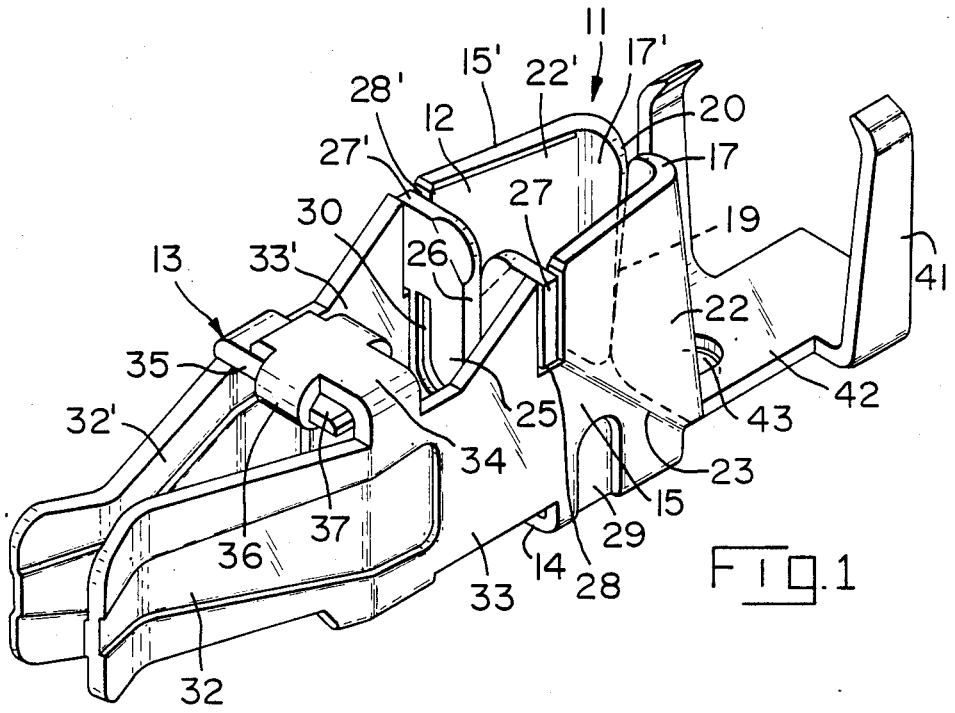
FIG. 1 is an isometric view of the terminal from a contact end.
Figure 2:
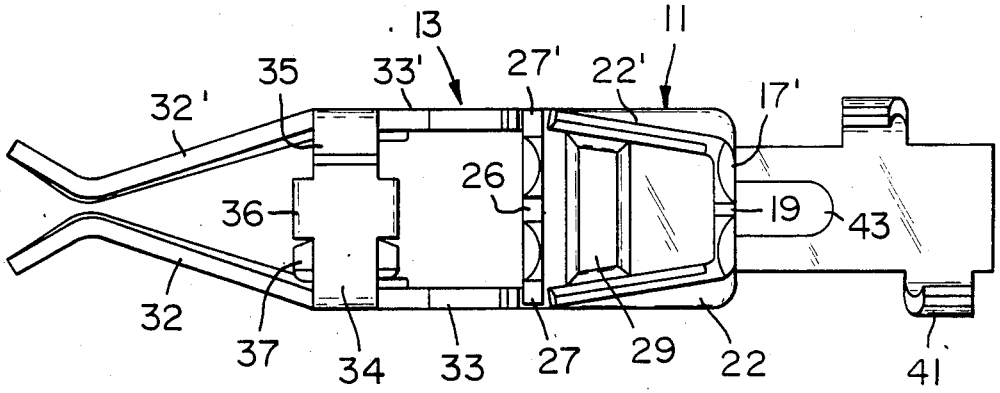
FIG. 2 is a plan view of the terminal.
Figure 3:
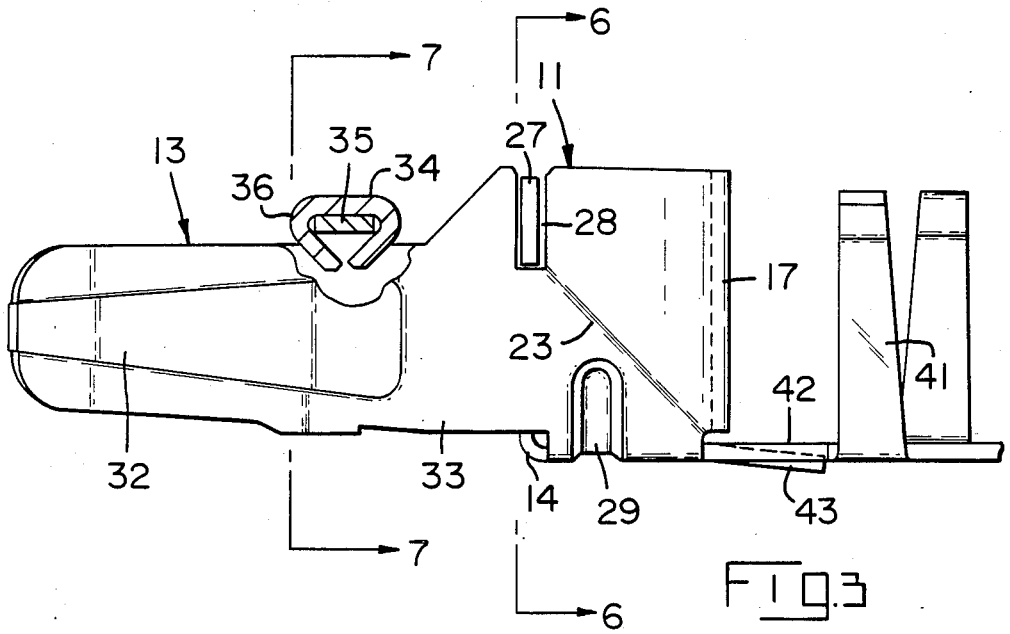
FIG. 3 is a side elevation of the terminal with a portion broken away.
Figure 4:
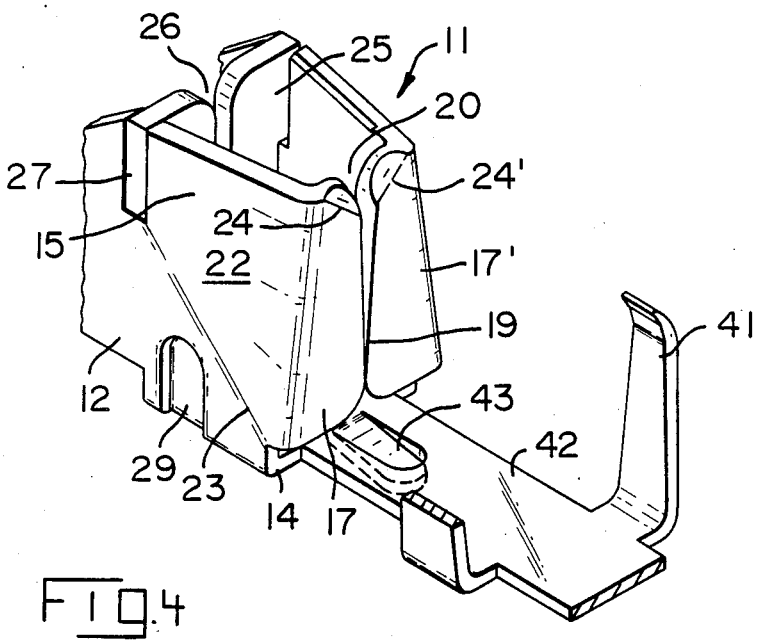
FIG. 4 is a fragmentary isometric view of a wire connecting end of the terminal.
Figure 5:
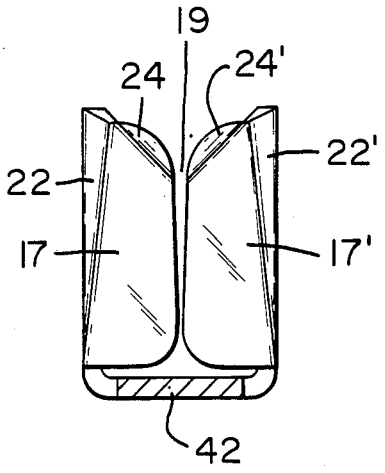
FIG. 5 is an end elevation, partly in section, of a compliant wire receiving slot.
Figure 6:
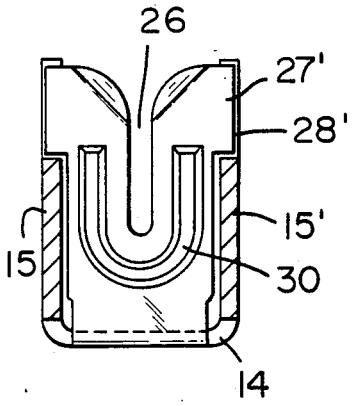
FIG. 6 is a cross-sectinal view along line 6—6 in FIG. 3 showing a rigid wire receiving slot.
Figure 7:
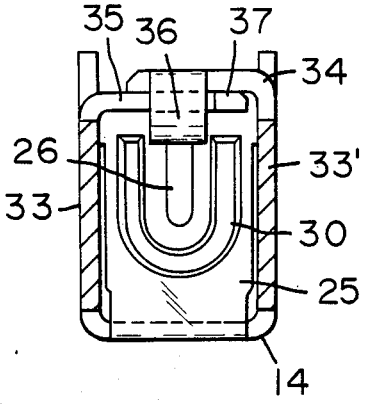
FIG. 7 is a cross-sectional view along line 7—7 in FIG. 3.

The terminal is stamped and formed from a single piece of sheet metal stock and comprises a wire connecting portion 11 including a body portion 12 of channel shape and a contact portion 13 extending from one axial end of the body portion.

The body portion comprises a base wall 14 from respective opposite sides of which upstand identical sidewalls 15 and 15'. Limbs 17 and 17' extend free of the base from axial ends of the respective sidewalls, and are bent towards each other perpendicularly of the channel axis so that their opposed free edges define between them a wire receiving slot 19 having a mouth 20 remote from the base. A portion 22, 22' of each sidewall adjacent a junction with a limb is pushed in along a fold line 23, 23' which extends from the junction of a limb at the base at its junction with a sidewall away from the limb and upwardly towards the free end of the sidewall. This portion defines a resilient gusset providing a spring characteristic of progressively increasing stiffness as it extends from the mouth of the slot to the base. Edge portions 24, 24' of the limbs adjacent the mouth are coined to provide a radiussed flared entry with insulation penetrating teeth.

A panel 25 is pushed up from the channel base to extend parallel to the limbs between the sidewalls and is formed with a rigid wire receiving slot 26 axially aligned with the compliant slot 19 and having similar insulation penetrating teeth. Lugs 27, 27' extend from opposite sides of the panel at an upper end and are received in vertical cut-outs 28, 28' extending downwardly from the upper portions of the sidewalls to the fold lines 23, 23' which locate the panel securely during wire insertion.

Stiffening embossments 29 and 30 are formed in the base wall and lower sidewalls 14 and the panel 25 respectively to enhance the rigidity of those parts.

The contact portion 13 comprises a pair of tab gripping legs 32, 32' extending longitudinally from axial extendions 33, 33' of the sidewalls of the body.

The sidewall extendions 32, 32' are secured together by first and second tie strips 34, 35, respectively, having root ends integral with upper edges of the extensions and first and second locking portions 36, 37, respectively, extending flag fashion adjacent free ends, the strips being bent at their root ends to extend towards each other between the sidewalls in overlapping relation. The first locking portion 36 comprises arms crimped around the second tie strip 35 at a location adjacent the second locking portion 37 which is thereby trapped between the first locking portion and the sidewall from which it extends.

A conventional crimping ferrule 41 with longitudinally staggered arms is provided as an axial extension 42 of the base wall. A latching detent 43 is pushed out of the extension 42 to latch the terminal in a housing.

The terminal is suitable for use with a very wide range of wire gauges, e.g., from 0.5 sq. mm to 1.5 sq. mm.

In use of the terminal, during insertion of an insulated stranded wire into the slots, the teeth of the compliant and rigid slots 19 and 26 will penetrate the insulation and the slot edges establish connection with the wire core throughout the entire range.

When the wires are inserted into the slots, the compliant slot will open progressively with a torsion spring component, penetrating the insulation and contacting the core without severing individual strands. The edges of the rigid slot may tend to sever some strands of the largest wires but the resulting weakened condition will be augmented by the second slot.

The tie strips both enhance the rigidity of the channel section body 12, the rigidity of the slot 26, and enhance the tab gripping force enabling the terminal to be made economically from relatively thin stock.

What is claimed is:

1. A terminal comprising a stamped and formed channel section body having sidewalls from axial ends of which extend limbs free of the channel base and bent towards each other perpendicularly of the channel axis with their opposed edges defining between them a wire receiving slot having a mouth remote from the channel base, characterized in that a portion of at least one of the sidewalls adjacent the junction with the limb is progressively inclined inwardly of the channel as it extends upwardly away from the base and towards the limb, the portion being defined by pushing in the sidewall along a fold line extending from the junction of the limb and the sidewall adjacent the base away from the limb and upwardly towards the free end of the sidewall such that the portion provides a resilient gusset of progressively increasing width and of progressively decreasing stiffness as it extends upwardly away from the base and deflects with a torsion spring characteristic during insertion of a wire into the slot.

2. A terminal according to claim 1, characterized in that, the slot tapers progressively taper in width as it extends from the mouth towards the base.

3. A terminal according to claim 1 or claim 2, characterized in that, the sidewalls are secured together by first and second tie strips having root ends integral with upper edges of respective sidewalls and first and second transverse locking portions extending flag fashion adjacent free ends, the strips being bent at their root ends to extend towards each other between the sidewalls in overlapping relation and the first locking portion being crimped around the second tie strip to trap the second locking portion between the first locking portion and the sidewall from which it extends.

4. A terminal according to claim 2, characterized in that, a panel having another, rigid slot is bent to extend perpendicularly across the channel with the other slot axially aligned with the one slot, the width of the other slot being greater than the one slot in an unexpanded wire receiving condition.

5. A terminal according to claim 4, characterized in that, relative widths of the slots are such that when wires throughout the entire range are inserted into the slots, both slots will effect electrical connection to the wire.

6. A terminal according to claim 4, characterized in that, the panel is pushed out from the channel base and has one or more laterally extending lugs received in cut-outs in the sidewalls to maintain the panel upstanding from the base during the insertion of wire into the slots.

* * * * *

UNITED STATES PATENT AND TRADEMARK OFFICE

CERTIFICATE OF CORRECTION

PATENT NO. : 4,699,441

DATED : October 13, 1987

INVENTOR(S) : Gianfranco D'Urso et al

It is certified that error appears in the above-identified patent and that said Letters Patent is hereby corrected as shown below:

Column 4, line 52, Claim 4, delete "tapers" and add an ---s---to the word "taper".

Signed and Sealed this

Eighth Day of March, 1988

*Attest:*

DONALD J. QUIGG

*Attesting Officer*

*Commissioner of Patents and Trademarks*